US011572750B2

(12) United States Patent
Payne et al.

(10) Patent No.: US 11,572,750 B2
(45) Date of Patent: Feb. 7, 2023

(54) LINER HANGER WITH ENHANCED LOCKING ASSEMBLY

(71) Applicant: Dril-Quip, Inc., Houston, TX (US)

(72) Inventors: Curtis W. Payne, Richmond, TX (US); Jacob S. Warneke, Houston, TX (US); Steven M. Zakharia, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 17/289,640

(22) PCT Filed: Nov. 1, 2019

(86) PCT No.: PCT/US2019/059499

§ 371 (c)(1),
(2) Date: Apr. 28, 2021

(87) PCT Pub. No.: WO2020/092977

PCT Pub. Date: May 7, 2020

(65) Prior Publication Data

US 2021/0396086 A1 Dec. 23, 2021

Related U.S. Application Data

(60) Provisional application No. 62/754,927, filed on Nov. 2, 2018.

(51) Int. Cl.
*E21B 23/01* (2006.01)
*E21B 33/128* (2006.01)
(Continued)

(52) U.S. Cl.
CPC ..... *E21B 23/01* (2013.01); *E21B 33/128* (2013.01); *E21B 33/1293* (2013.01); *E21B 43/10* (2013.01)

(58) Field of Classification Search
CPC .. E21B 23/01–04; E21B 23/06; E21B 33/128; E21B 33/1291; E21B 33/1293; E21B 33/1295; E21B 43/10
See application file for complete search history.

(56) References Cited

U.S. PATENT DOCUMENTS 4,059,150 A 11/1977 Manderscheid
4,311,194 A * 1/1982 White ..... E21B 23/06 166/120

(Continued)

OTHER PUBLICATIONS

International Search Report and Written Opinion issued in related PCT Application No. PCT/US2019/059499 dated Apr. 8, 2020, 11 pages.

*Primary Examiner* — Taras P Bemko
*Assistant Examiner* — Ronald R Runyan
(74) *Attorney, Agent, or Firm* — Baker Botts L.L.P.

(57) ABSTRACT

A liner hanger having one: or more enhanced Socking assemblies is provided. The liner hanger includes a liner hanger body, lower slips, upper slips, a packer cone, and a seal that seals an annulus between the liner hanger and an outer casing, The one or more enhanced locking assemblies may include: a packer cone locking assembly that prevents all components of the liner hanger from actuating until it is unlocked; a slips locking assembly that prevents the lower slips from being actuated until it is unlocked; guide rails that prevent. the lower slips and/or the upper slips from being wedged in a radially outward direction during run in; and a floating cone locking assembly that releases the packer cone from being coupled to a spacer of the liner hanger when it is unlocked.

20 Claims, 12 Drawing Sheets

(51) Int. Cl.
*E21B 33/129* (2006.01)
*E21B 43/10* (2006.01)

(56) References Cited

U.S. PATENT DOCUMENTS

| | | | | |
|---|---|---|---|---|
| 4,393,929 | A | 7/1983 | Akkerman | |
| 4,423,777 | A | 1/1984 | Mullins et al. | |
| 6,722,428 | B2 * | 4/2004 | Yokley | E21B 43/10 166/216 |
| 2005/0006106 | A1 * | 1/2005 | Hirth | E21B 43/10 166/208 |
| 2011/0168411 | A1 * | 7/2011 | Braddick | E21B 43/103 166/120 |
| 2014/0299332 | A1 | 10/2014 | Rood | |
| 2016/0245039 | A1 | 8/2016 | Goodman et al. | |
| 2016/0326831 | A1 * | 11/2016 | Reinhardt | E21B 33/128 |

* cited by examiner

LINER HANGER WITH ENHANCED LOCKING ASSEMBLY

CROSS-REFERENCE TO RELATED APPLICATIONS

The present application is a U.S. National Stage Application of International Application No. PCT/US2019/059499 filed Nov. 1, 2019, which claims priority to U.S. Provisional Application Ser. No. 62/754,927 filed on Nov. 2, 2018 both of which are incorporated herein by reference in their entirety for all purposes.

TECHNICAL FIELD

The present disclosure relates generally to liner hangers and, more particularly, to a liner hanger with one or more enhanced locking assemblies.

BACKGROUND

When drilling a well, a borehole is typically drilled from the earth's surface to a selected depth and a string of casing is suspended and then cemented in place within the borehole. A drill bit is then passed through the initial cased borehole and is used to drill a smaller diameter borehole to an even greater depth. A smaller diameter casing is then suspended and cemented in place within the new borehole. This is repeated until a plurality of concentric casings are suspended and cemented within the well to a depth, which causes the well to extend through one or more hydrocarbon producing formations.

Rather than suspending a concentric casing from the bottom of the borehole to the surface, a liner is often suspended adjacent to the lower end of the previously suspended casing, or from a previously suspended and cemented liner, so as to extend the liner from the previously set casing or liner to the bottom of the new borehole. A liner is defined as casing that is not run to the surface. A liner hanger is used to suspend the liner within the lower end of the previously set casing or liner.

A running and setting tool disposed on the lower end of a work string may be releasably connected to the liner hanger, which is attached to the top of the liner. The work string lowers the liner hanger and liner into the open borehole until the liner hanger is adjacent the lower end of the previously set casing or liner, with the lower end of the liner typically slightly above the bottom of the open borehole. When the liner reaches the desired location relative to the bottom of the open borehole and the previously set casing or liner, a setting mechanism is actuated to move an anchoring element (e.g., slips) on the liner hanger into engagement with the previously set casing or liner. A packer element is also included in liner hanger systems to seal the annulus between the liner and the previously set casing. The packer element may be radially set by axial movement of the packer element relative to a conical wedge ring (or packer cone) on the liner hanger.

In conventional liner hanger systems, the packer, slips, and various actuated components are often locked in place during run in via a series of shear pins. It is now recognized that a need exists for enhanced locking assemblies that will maintain the liner hanger elements in place during run in and enable smooth actuation of the liner hanger once it reaches depth.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to a liner hanger having one or more enhanced locking assemblies.

Figure 1:
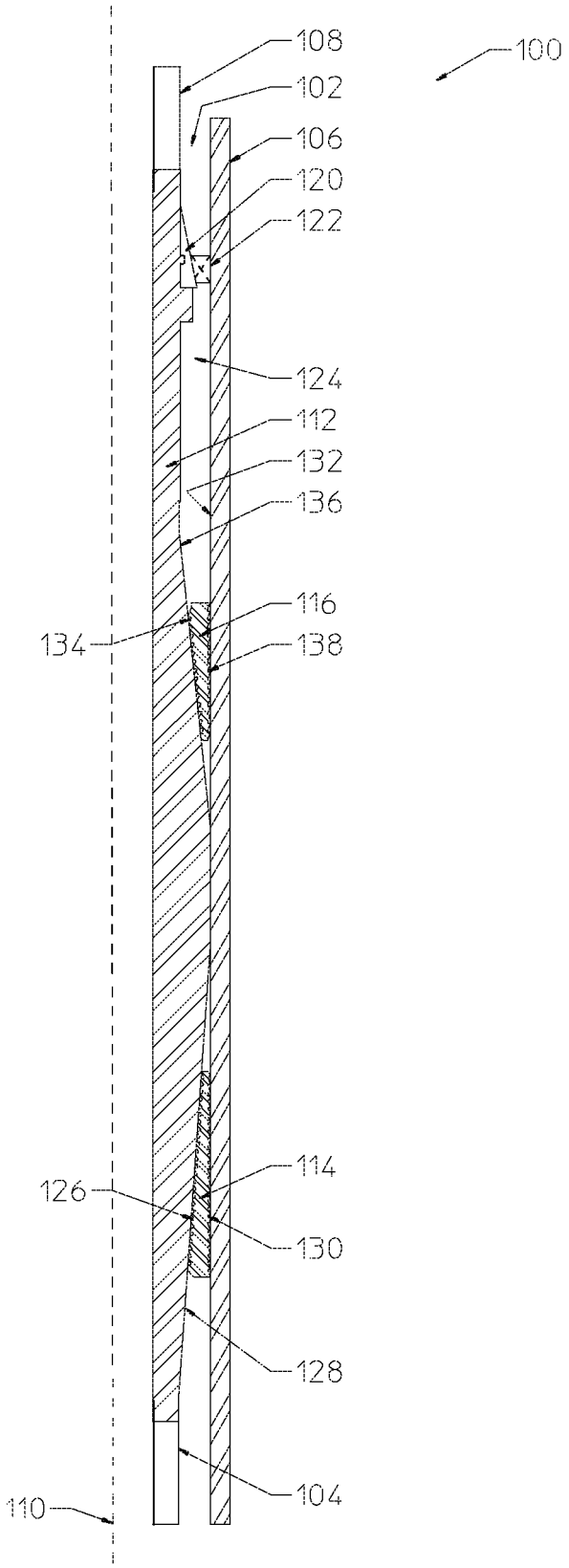
FIG. 1 is a cross sectional schematic view of a liner hanger, in accordance with an embodiment of the present disclosure.

In liner hanger systems, a pair of slips (or single slip component) is used to set a liner hanger at an axial position within a casing, and a packer is used to seal the annular space between the liner hanger and the casing so as to isolate pressure within the annulus. FIG. 1 illustrates a wellbore system 100 in which a liner hanger 102 is used to hang a liner 104 within an outer casing 106. The liner hanger 102 is run downhole with the liner 104 via a liner hanger running tool 108, which is used to actuate the liner hanger 102 once the liner hanger 102 has reached a desired depth. The illustrated cross section only shows the wellbore system 100 on one side of a longitudinal axis 110. It will be understood that the liner wellbore system 100 and its constituent parts are generally tubular and therefore extend all the way around the axis 110.

The liner hanger 102 includes, among other things, a liner hanger body 112, lower slips 114 (i.e., hanging slips), upper slips 116 (i.e., hold-down slips), a packer cone 120, and a seal 122 that seals an annulus 124 between the liner hanger 102 and the outer casing 106.

The lower slips 114 may be set in the annulus 124 between the liner hanger 102 and the casing 106 to prevent the liner hanger 102 from moving axially downward relative to the casing 106. The lower slips 114 may include one or more frustoconical inner walls 126. The frustoconical inner wall(s) 126 of the lower slips 114 slant radially inward in a downhole direction to engage one or more complementary frustoconical surfaces 128 on the liner hanger 102. The frustoconical inner wall(s) 126 of the lower slips 114 may have teeth formed therein. The complementary frustoconical surface(s) 128 of the liner hanger 102 may be integral with the main liner hanger body 112 or may be one or more separate components coupled to the outside of the main liner hanger body 112. The lower slips 114 may include an outer wall 130 with teeth formed therein to grip a radially internal surface 132 of the casing 106. The frustoconical inner wall(s) 126 and teeth on the lower slips 114 are oriented such that the lower slips 114, once set between the frustoconical surface(s) 128 of the liner hanger 102 and the radially internal surface 132 of the casing 106, prevents the liner hanger 102 from moving axially downward relative to the casing 106.

The upper slips 116 may be set in the annulus 124 between the liner hanger 102 and the casing 106 to prevent the liner hanger 102 from moving axially upward relative to the casing 106. The upper slips 116 may include one or more frustoconical inner walls 134. The frustoconical inner wall(s) 134 of the upper slips 116 slant radially outward in a downhole direction to engage one or more complementary frustoconical surfaces 136 on the liner hanger 102. The frustoconical inner wall(s) 134 of the upper slips 116 may have teeth formed therein. The complementary frustoconical surface(s) 136 of the liner hanger 102 may be integral with the main liner hanger body 112 or may be one or more separate components coupled to the outside of the main liner hanger body 112. The upper slips 116 may include an outer wall 138 with teeth formed therein to grip the radially internal surface 132 of the casing 106. The frustoconical inner wall(s) 134 and teeth on the upper slips 116 are oriented such that the upper slips 116, once set between the frustoconical surface(s) 136 of the liner hanger 102 and the radially internal surface 132 of the casing 106, prevents the liner hanger 102 from moving axially upward relative to the casing 106.

After the slips 114 and 116 are set, the seal 122 may be set and energized against the packer cone 120 of the liner hanger 102 and the radially internal surface 132 of the casing 106. As shown, the packer cone 120 is a frustoconical surface that slopes radially outward in a downhole direction. In some embodiments, the packer cone 120 may be integral with the main liner hanger body 112. In other embodiments, as discussed in greater detail below, the packer cone 120 may be a separate component that can be de-coupled from the main body 112 of the liner hanger 102.

The liner hanger 102 in accordance with presently disclosed embodiments contains one or more enhanced locking assemblies. These locking assemblies may include, for example, one or more of the following: a packer cone locking assembly that (when locked) prevents all components of the liner hanger 102 (including the packer cone 120) from actuating; a slip locking assembly that (when locked) prevents the lower slips 114 from being actuated into engagement with the frustoconical surface(s) 128 of the liner hanger 102; guide rails that prevent the lower slips 114 and/or the upper slips 116 from being wedged in a radially outward direction during run in; and a floating cone locking assembly that (when unlocked) releases the packer cone 120 from being coupled to other accessories of the liner hanger 102 so that the cone 120 can then float relative to the other accessories of the liner hanger 102. Each of these different locking assemblies will be described in detail below.

Figure 2:
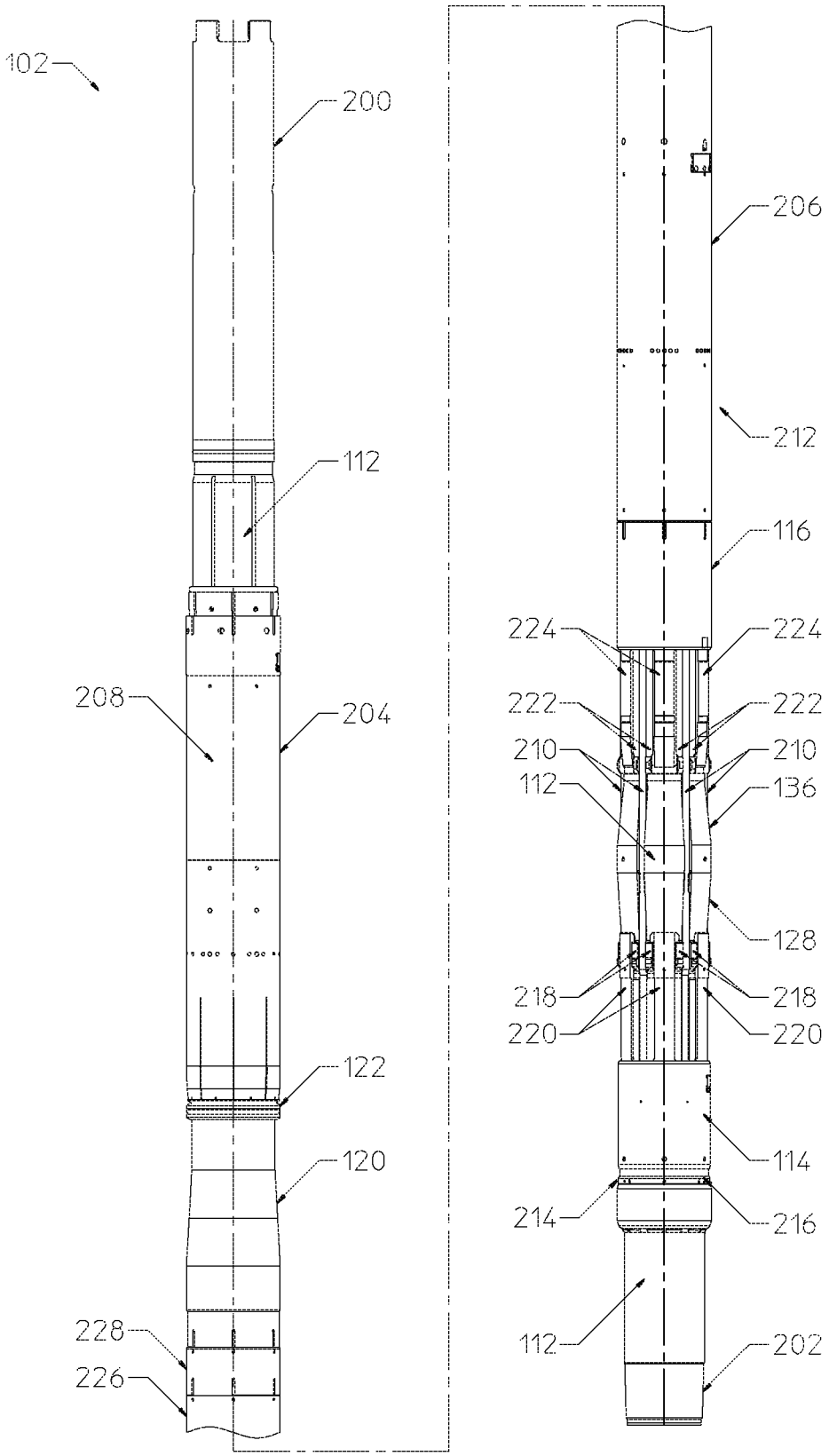
FIG. 2 is a perspective side view of a liner hanger having multiple enhanced locking assemblies, in accordance with an embodiment of the present disclosure.

FIG. 2 illustrates an embodiment of the liner hanger 102 that includes each of the four above listed enhanced locking assemblies. It should be noted that other embodiments of the liner hanger 102 may be equipped with just one, two, or three of the above listed enhanced locking assemblies. All of the locking assemblies may work in concert to provide a liner hanger 102 with components that are locked in place for run-in without the primary use of shear pins. The individual locking assemblies may provide various additional benefits that are described below.

The liner hanger 102 of FIG. 2 includes the main body 112, which runs from a running tool adapter 200 at an upper end to a liner connector 202 at a lower end opposite the upper end. The running tool adapter 200 directly couples the liner hanger 102 to the liner hanger running tool (e.g., 108 of FIG. 1), and the liner connector 202 connects the liner (e.g., 104 of FIG. 1) to the liner hanger 102. The main body 112 may run through a number of other components of the liner hanger 102, including a pusher sleeve 204, the seal 122, the packer cone 120, a spacer 206, the lower slips 114, and the upper slips 116. In the illustrated embodiment, the frustoconical surfaces 128 and 136, which the slips (114 and 116, respectively) will be set against, are integral with the main body 112.

The liner hanger 102 may include a packer cone locking assembly (represented by element number 208) that includes the pusher sleeve 204. The packer cone locking assembly 208 includes other components as well that are covered by the pusher sleeve 204 and therefore not visible in FIG. 2. The packer cone locking assembly 208 is described below with reference to FIGS. 3 and 4A, 4B, 4C, 4D.

The liner hanger 102 may actuate the lower slips 114 using a series of tie-bars 210, which extend axially along a portion of the liner hanger 102. The tie-bans 210, as shown, may each be positioned at different orientations about the circumference of the main body 112. The tie-bars 210 may be moved via an actuation assembly (represented by element number 212). The actuation assembly 212 includes components that are covered by the spacer 206 and therefore not visible in FIG. 2. The actuation assembly 212 is described below with reference to FIG. 5.

The liner hanger 102 may include a slip locking assembly (represented by element number 214) that includes a collet 216 coupled to the lower slips 114. The slip locking assembly 214 includes other components as well that are covered by the lower slips 114 and therefore not visible in FIG. 2.

The slip locking assembly 214 is described in detail below with reference to FIGS. 7A, 7B, 7C.

The liner hanger 102 may include a series of anti-wedge guide rails 218 either located on or formed in the main body 112 and extending into spaces between adjacent arms 220 of the lower slips 114. The liner hanger 102 may also include a series of anti-wedge guide rails 222 either located on or formed in the main body 112 and extending into spaces between adjacent arms 224 of the upper slips 116. The anti-wedge guide rails 218 and 222 are described in detail below with reference to FIGS. 7A, 7B. 7C and 8A, 8B, 8C, respectively.

The liner hanger 102 may include a floating cone locking assembly (represented by element number 226) that includes a collet 228 coupled to the spacer 206. The floating cone locking assembly 226 includes other components as well that are covered by the spacer 206 and therefore not visible in FIG. 2. The floating cone locking assembly 226 is described in detail below with reference to FIGS. 9, 10, 11A, and 11B.

The method of operating the liner hanger 102 of FIG. 2 is as follows. First, the running tool (e.g., 108 of FIG. 1) runs the liner hanger 102 to depth within the wellbore. While running the liner hanger 102 into the well, the various locking assemblies (e.g., 208, 214, 218, 222, and 226) keep the components of the liner hanger 102 from actuating prematurely.

When the desired depth is reached, a ball is dropped through the running tool and pressure is applied to an inner bore of the running tool. This pressuring up of the running tool applies a force in an upward direction through a load path that includes the pushing sleeve 204. The pushing sleeve 204 moves upward relative to the main body 112 of the liner hanger 112, and this movement of the pushing sleeve 204 unlocks the packer cone locking assembly 208. Further upward force through the load path moves the packer cone 120 and the spacer 206 in an upward direction, and the actuation assembly 212 moves the tie-bars 210 in the upward direction as well. This movement of the tie-bars 210 unlocks the slip locking assembly 214, thereby enabling the lower slips 114 to be set between the liner hanger main body 112 and the outer casing (e.g., 106 of FIG. 1).

After the lower slips 114 are set, the method includes setting down the weight of the liner and liner hanger 102 on the lower slips 114. Once the lower slips 114 are carrying the full weight of the liner and liner hanger 102 (instead of the running tool), the running tool releases from the liner hanger 102. At this point the liner may be cemented in place within the wellbore. The running tool is then used to set down weight on the load path of the liner hanger 102. This set down weight activates the liner hanger 102 to set the upper slips 116 and to de-couple the packer cone 120 from the spacer 206 (via the floating cone locking assembly 226). Additional set down weight moves the pusher sleeve 204 downward to activate the seal 122 between the packer cone 120 and the radially internal surface of the casing. At this point, the liner hanger 102 is fully set and sealed. Each of these steps is described in FIG. 12.

Having now described the liner hanger assembly 102 in general, the following discussion will focus on each of the different types of locking assemblies that may be used throughout the liner hanger 102.

Figure 3:
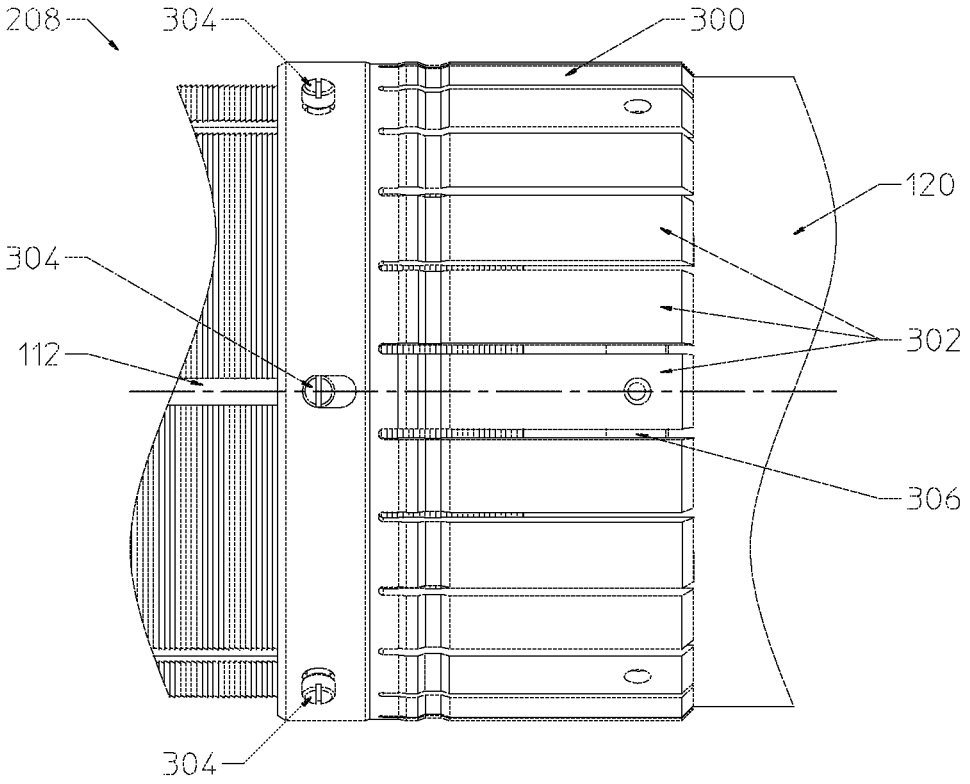
FIG. 3 is a perspective partial cutaway view of a packer cone locking assembly of the liner hanger of FIG. 2, in accordance with an embodiment of the present disclosure.

Packer Cone Locking Assembly:

FIG. 3 illustrates the packer cone locking assembly 208. The packer cone locking assembly 208 includes a collet 300. The collet 300 includes a plurality of flexible fingers 302 extended in an axial direction and configured to flex radially in response to axial movement of the collet 300. The collet 300 may be coupled to the pusher sleeve (e.g., 204 of FIG. 2) via one or more shear pins 304. The collet 300 is radially inwardly biased and disposed over a row of lugs 306 that fit into groove(s) 308 (see FIGS. 4A, 4B) formed in the main body 112 when the packer cone locking assembly 208 is locked.

Figure 4A:
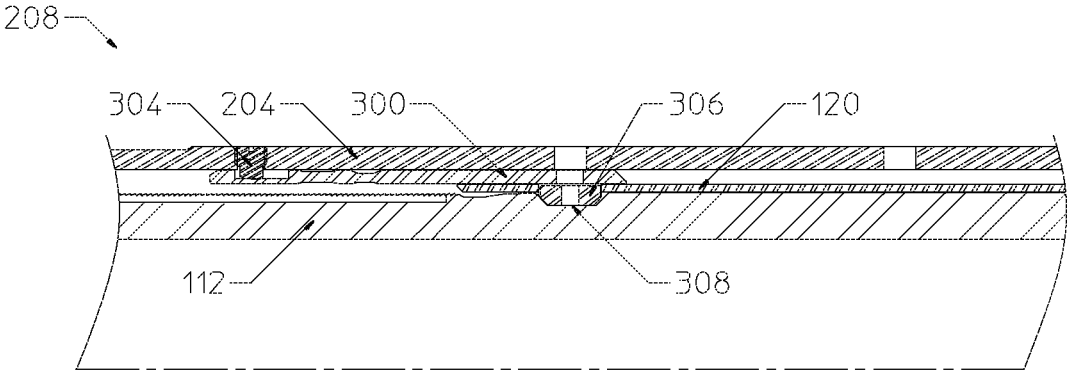
FIGS. 4A, 4B, 4C, 4D are cross-sectional views of the packer cone locking assembly of FIG. 3 during operation of the liner hanger, in accordance with an embodiment of the present disclosure.
Figure 4B:
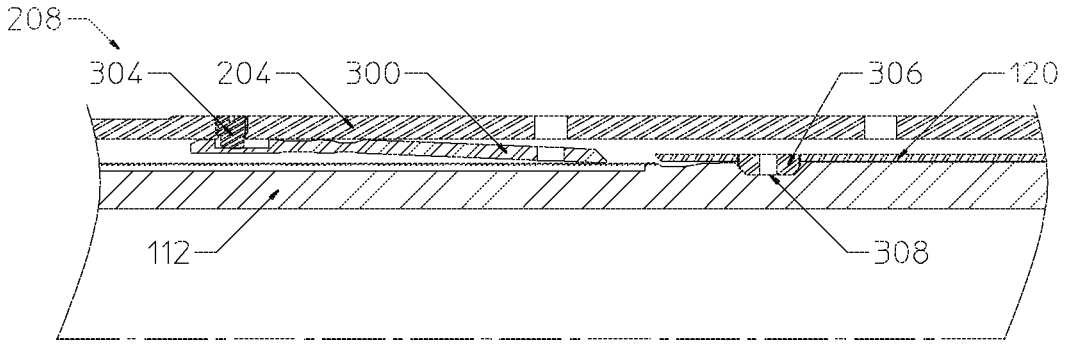

FIG. 4A shows the packer cone locking assembly 208 in the locked configuration, as it is while the liner hanger 102 is being run in the well. While running in hole, the packer cone 120 is mechanically locked to the main body 112 of the liner hanger 102 via the lugs 306 trapped by the inwardly biased collet 300. As shown, the lugs 306 may be disposed within one or more slots formed at an axial location within the packer cone 120. The collet 300 prevents the lugs 306 from sliding out of the groove(s) 308 and mechanically locks the packer cone 120 while the liner hanger 102 is running in hole. While the liner hanger 102 is run in, any load acting on the packer cone 120 is transferred into the main body 112 through the lugs 306 trapped by the collet fingers 302. All load and drag forces on the packer cone 120 are automatically transferred to the main body 112 through the trapped lugs 306. While in the running position, the lugs 306 turn axial loads on the packer cone 120 into radial loads on the main body 112, and these radial loads are turned into hoop loads.

As shown in FIG. 40, when the pusher sleeve 204 moves upward in response to pressuring up on the running tool, the pusher sleeve 204 pulls the collet 300 upward (via the shear pin connection), thereby causing the collet 300 to uncover the lugs 306 and the packer cone 120. Once uncovered, the lugs 306 are able to move radially outward out of the grooves 308, thereby freeing the packer cone 120 from its connection to the main body 112. The packer cone 120 is now able to move axially with respect to the main body 112. Once the packer cone 120 and lugs 306 are uncovered, the collet fingers 302 collapse radially inward into their machined state to prevent the collet 300 from re-covering the lugs 306 and unintentionally re-locking the packer cone 120.

Figure 4C:
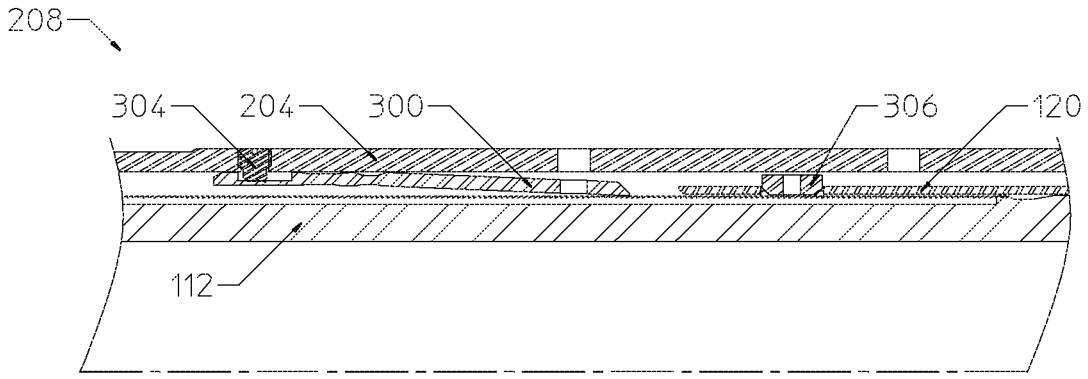

Once unlocked, further pressuring up via the running tool pulls the packer cone 120 upward, and this movement of the packer cone 120 pulls the lugs 306 out of the groove(s) 308 on the main body 112, as illustrated in FIG. 4C.

Figure 4D:
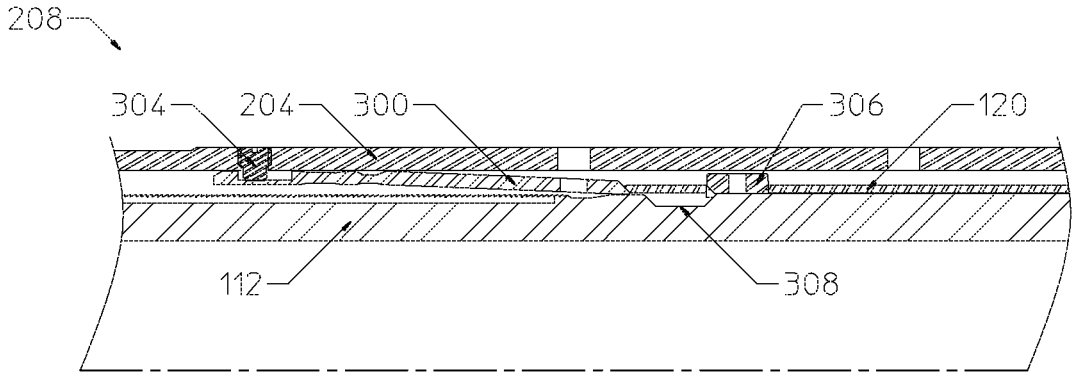

The packer cone locking assembly 208 acts as a master lock for the entire liner hanger 102. As such, once the packer cone locking assembly 208 is unlocked, all other components of the liner hanger 102 can then be actuated. The packer cone 120 may be pulled upward, as shown in FIG. 4C, and later pushed back downward as shown in FIG. 4D (due to setting weight down on the liner hanger 102) without the packer cone locking assembly 208 re-locking. This downward movement of the pusher sleeve 204, packer cone 120, and lugs 306 with respect to the main body 112 can be used to set the upper slips.

When a greater weight is later set down on the liner hanger 102 via the running tool, the downward force acting on the pusher sleeve 204 will shear the pin 304 between the pusher sleeve 204 and the collet 300, thereby enabling the pusher sleeve 204 to push the seal (122 of FIG. 2) down the packer cone 120 to engage the seal.

Another benefit of the disclosed packer cone locking assembly 208 is that if attempts to pressure up the running tool fail for any reason, it is possible to set the liner on the bottom of the well and subsequently unlock the packer cone locking assembly 208. Specifically, after setting the liner on bottom, the liner hanger 102 may be released from the running tool and the running tool may set down weight on the liner hanger 102. This set down weight will still unlock the collet-based packer cone locking assembly 208, by forcing the collet 300 in a downward direction along with the pusher sleeve 204 until the collet 300 passes over the lugs 306, without the need for the collet 300 to collapse. As such, the packer cone locking assembly 208 can be unlocked using either an upward or downward motion of the pusher sleeve 204. The distance of travel required to unlock the packer cone locking assembly 208 via downward movement of the pusher sleeve 204 is larger such that it will not be accidentally unlocked via the running tool performing an emergency disconnect operation.

Figure 5:
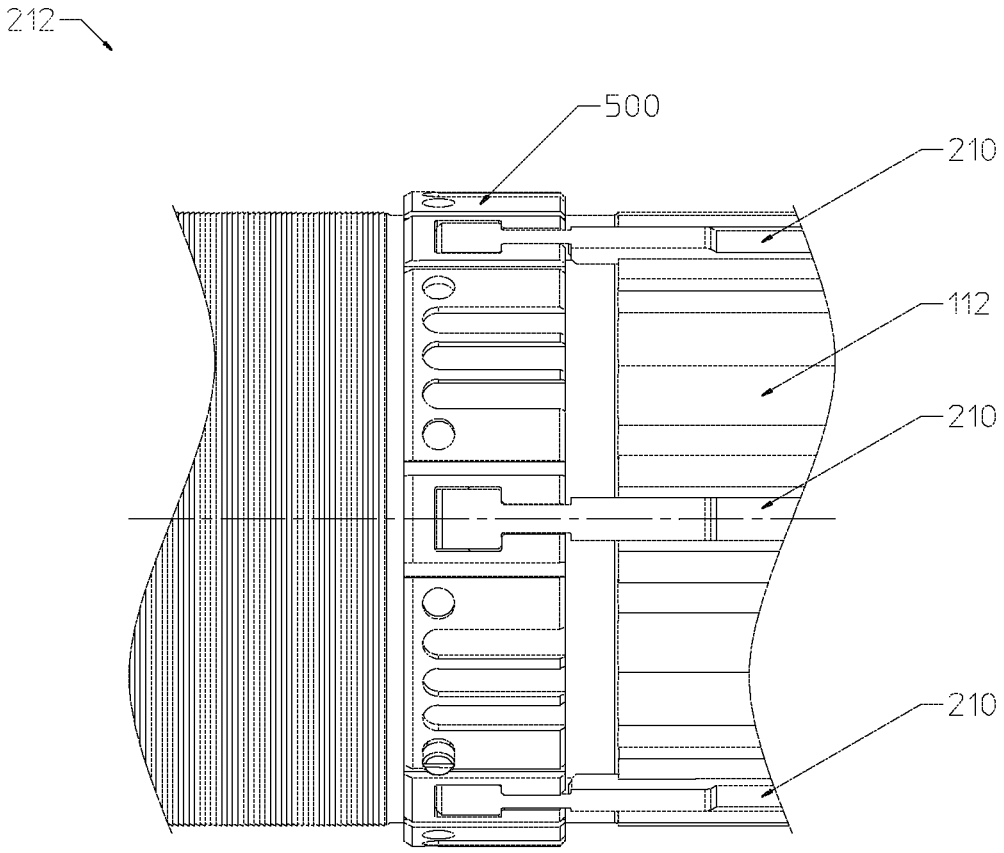
FIG. 5 is a perspective cutaway view of a ring and tie-bars of the liner hanger of FIG. 2, in accordance with an embodiment of the present disclosure.

Slip Locking Assembly:

FIG. 5 shows the actuation assembly 212 used to move the tie-bars 210 as the running tool is further pressured up and pulling upward on the liner hanger 102. The actuation assembly 212 may include a ring 500 that connects the tie-bars 210 to the spacer (e.g., 206 of FIG. 2). The ring 500 is attached to a radially internal surface of the spacer (206), for example by being received in grooves, and the upper ends of the tie-bars 210 are connected to the ring 500 such that movement of the spacer (206) in the upward direction urges the ring 500 and the tie-bars upward as well. As such, upward movement of the spacer (206) in response to pressuring up the running tool will move the tie-bars 210 upward, and this upward movement of the tie-bars 210 is used to unlock the lower slip locking assembly.

Figure 6A:
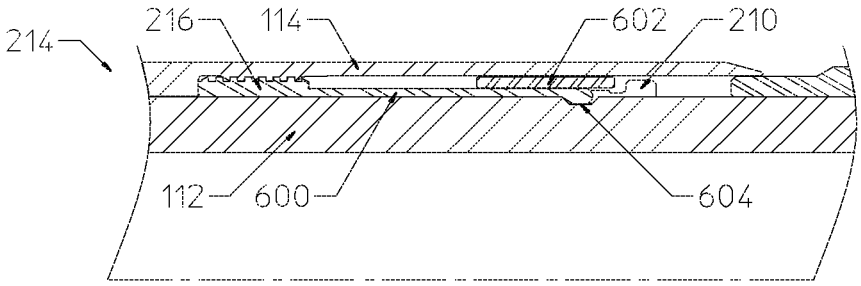
FIGS. 6A, 6B, 6C are cross-sectional views of a slip locking assembly of the liner hanger of FIG. 2 during operation of the liner hanger, in accordance with an embodiment of the present disclosure.
Figure 6B:
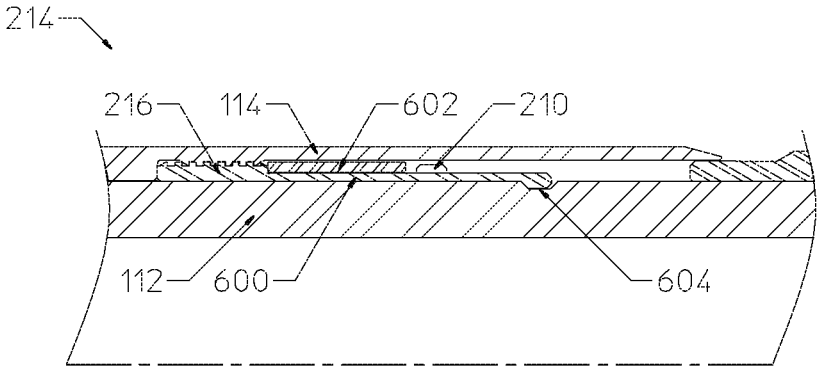
Figure 6C:
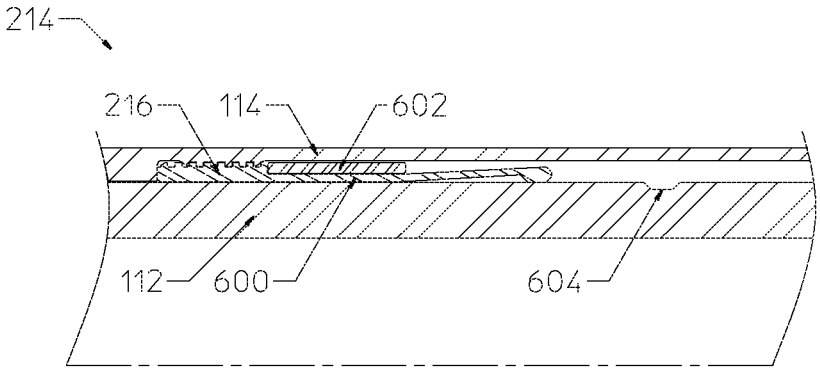

FIGS. 6A, 6B, 6C illustrate the slip locking assembly 214 in greater detail. The slip locking assembly 214 locks the lower slips 114 to the liner hanger main body 112 via the collet 216. As illustrated, the slips 114 may be connected to the collet 216 via threads, such that until the collet 216 is free to move axially, the slips 114 cannot be set. The collet 216 includes a plurality of flexible fingers 600 that are able to flex radially outward in response to an axial force on the collet 216. The slips 114 are directly locked to the main body 112 via the collet 216, which is constrained in the radial direction by a solid ring 602 that is fitted radially over the collet fingers 600. The lower ends of the tie-bars 210 interact with the ring 602 to unlock/disengage the locking assembly. The slip locking assembly 214 must be disengaged prior to activating the lower slips 114.

FIG. 6A illustrates the slip locking assembly 214 in the locked configuration. In this configuration, the fingers 600 of the collet 216 are positioned in a groove 604 formed in the main body 112 of the liner hanger 102 and covered by the lock ring 602. The lock ring 602 forcing the collet fingers 600 into the groove 604 will keep the lower slips 114 locked in place while the liner hanger 102 is being run in hole, so as to prevent any premature deployment of the slips 114.

FIG. 6B shows the slip locking assembly 214 being actuated to unlock the lower slips 114 in response to a pull-up action of the tie-bars 210. The slips 114 may be unlocked by pulling upward on the tie-bars 210, which interface with the lock ring 602 to urge the ring 602 axially away from the ends of the flexible collet fingers 600. This removes the radial constraint of the collet 216, thereby allowing the fingers 600 to flex radially outward. As the tie-bars 210 continue to pull upward, the tie-bars 210 and lock ring 602 transfer the axially upward force to the collet 216, which pulls the collet fingers 600 out of the groove 604, as shown in FIG. 6C. This frees the collet 216 and the attached slips 114 to move axially with respect to the main body 112, so that further upward force from the tie-bars 210 acts to pull the slips 114 upward to set the slips 114 against the frustoconical surface of the liner hanger 102.

Anti-Wedge Guide Rails

Figure 7A:
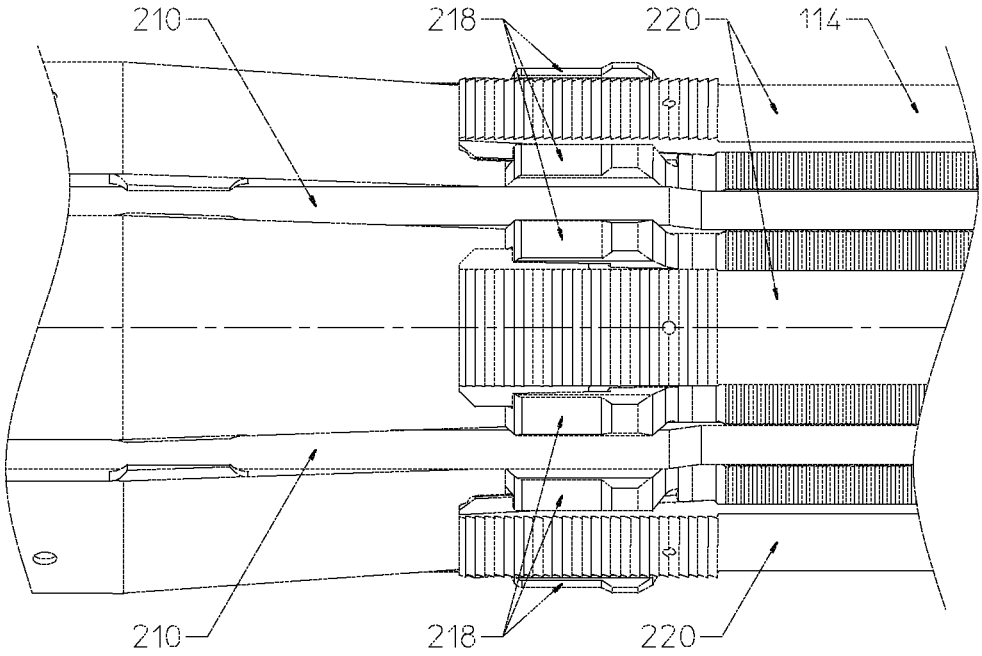
FIGS. 7A, 7B, 7C are perspective views of anti-wedge guide rails locking hanging slips of the liner hanger assembly of FIG. 2, in accordance with an embodiment of the present disclosure.
Figure 7B:
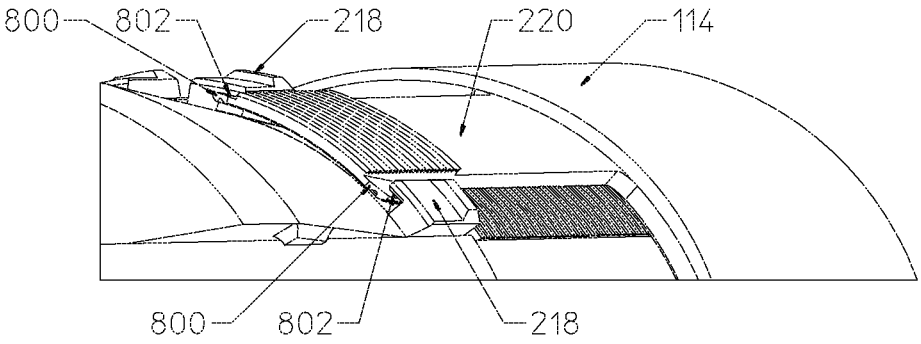
Figure 7C:
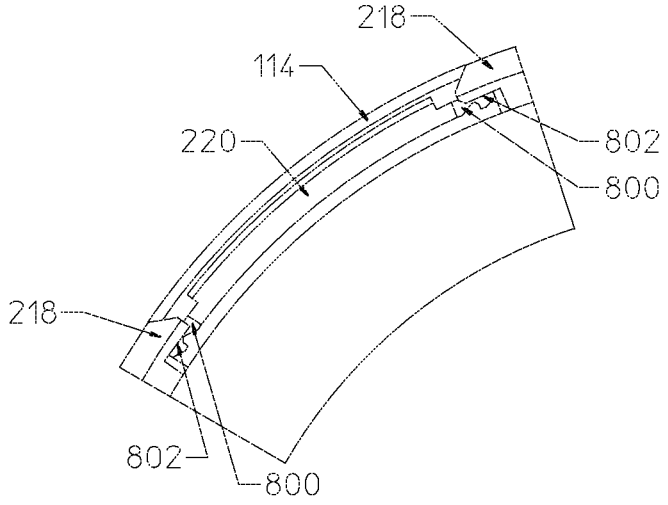
Figure 8A:
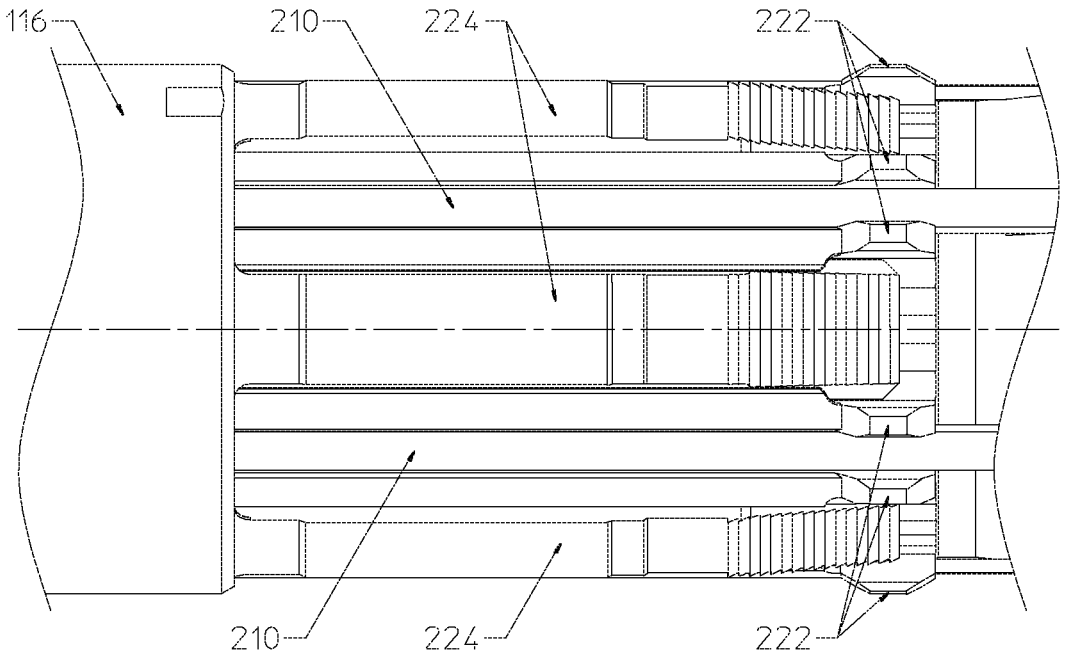
FIGS. 8A, 8B, 8C are perspective views of anti-wedge guide rails locking hold-down slips of the liner hanger assembly of FIG. 2, in accordance with an embodiment of the present disclosure.
Figure 8B:
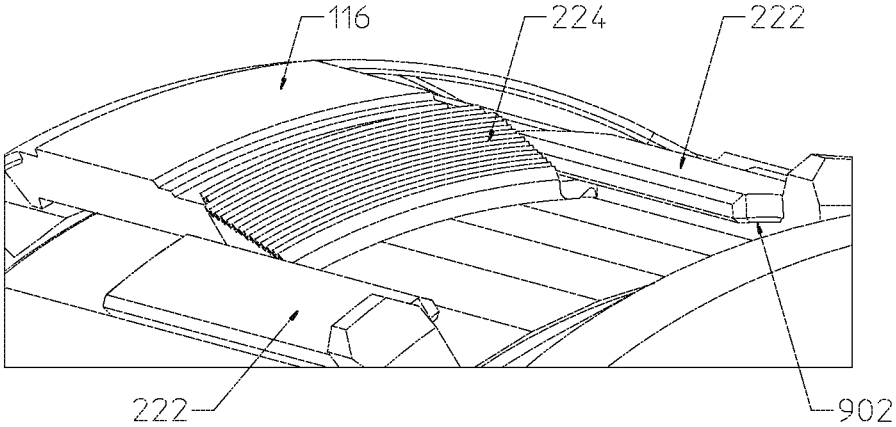
Figure 8C:
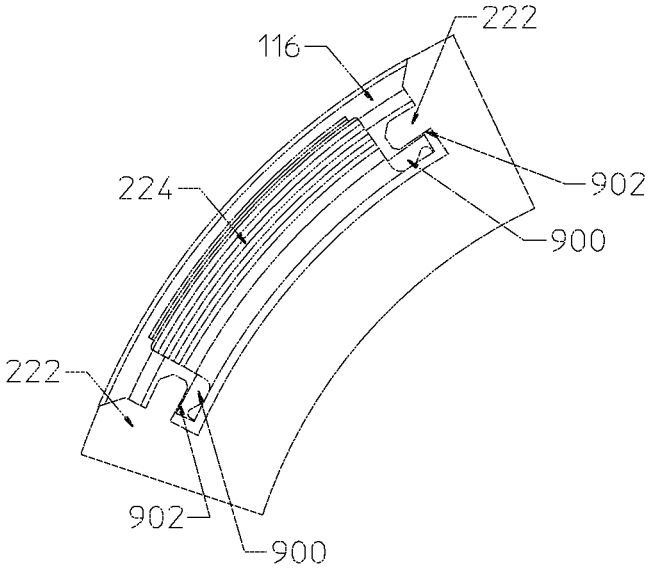

FIGS. 7A, 7B, 7C illustrate the anti-wedge guide rails 218 extending into spaces between adjacent arms 220 of the lower slips 114, and FIGS. 8A, 8B, 8C illustrate the anti-wedge guide rails 222 extending into spaces between adjacent arms 224 of the upper slips 116. The guide rails 218 and 222 formed on the main body 112 of the liner hanger 102 keep both sets of slips 114 and 116, respectively, from wedging radially outward during run in of the liner hanger 102. The disclosed liner hanger 102 may utilize collet slips for both the hanging slips 114 and the hold-down slips 116. While tripping in, the arms 220 and 224 of the collet slips 114 and 116, respectively, are susceptible to wedging radially outward due to tool movement or due to a build up of debris under the slip arms 220 and 224.

Turning specifically to FIGS. 7A, 7B, 7C, the main body 112 features guide rails 218 on both sides of each of the slip arms 220. An axially oriented groove formed between adjacent guide rails 218 may enable the tie-bars 210 to pass therethrough. The anti-wedge guide rails 218 prevent the slips 114 from wedging outward during run in by capturing winged portions 800 on opposite circumferential ends of each slip arm 220 within a locking profile 802 formed into the side of each guide rail 218. The locking profiles 802 capture the slip arms 220 therein until the slips 114 have been unlocked (via the locking assembly 214) and moved axially a distance to where the winged portions 800 of the arms 220 are no longer covered.

Turning to FIGS. 8A, 8B, 8C, the main body 112 features guide rails 222 on both sides of each of the slip arms 224. An axially oriented groove formed between adjacent guide rails 222 may enable the tie-bars 210 to pass therethrough. The anti-wedge guide rails 222 prevent the slips 116 from wedging outward during run in by capturing winged portions 900 on opposite circumferential ends of each slip arm 224 within a locking profile 902 formed into the side of each guide rail 222. The locking profiles 902 capture the slip arms 224 therein until the slips 116 have been moved axially a distance to where the winged portions 900 of the arms 224 are no longer covered. As illustrated, the guide rails 222 for the upper slips 116 may extend longer in an axial direction than the guide rails 218 for the lower slips 114, since the upper slips 116 will be moved axially with respect to the main body 112 a greater distance during the process of setting the liner hanger 102.

Figure 9:
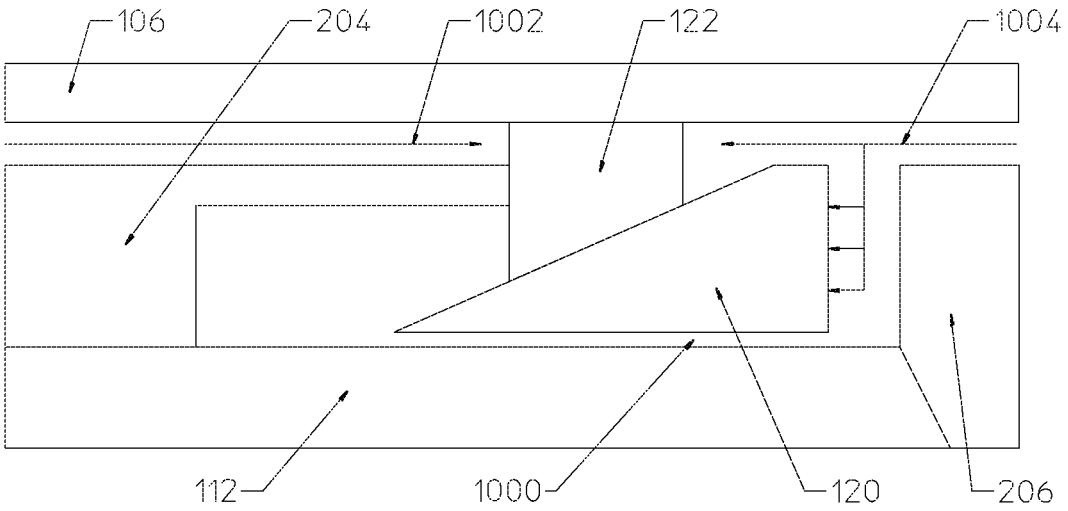
FIG. 9 is a free body diagram representing a seal and packer cone assembly of the liner hanger of FIG. 2, in accordance with an embodiment of the present disclosure.

Floating Cone Locking Assembly:

FIG. 9 depicts a block diagram representative of the floating packer cone which is enabled through the use of the floating cone locking assembly 226. Having a floating packer cone enables a bi-directional pressure boost within the packer assembly. As discussed above, the liner hanger 102 creates an annular seal by expanding and setting the packer seal 122 on the packer cone 120. Once the seal 122 is set on the packer cone 120, a pressure differential can be created on either side (above or below) of the seal 122.

In conventional liner hangers, the packer cone is constrained (fixed) to the main body and/or other elements within the liner hanger (e.g., spacer, slips, etc.). This creates a dominant side of the seal, whereby one side of the seal typically seals better against pressure than the other. For example, if pressure is applied on the "boosted" side (above) of the seal, this drives the seal harder into the cone, thereby creating a better seal. If pressure is applied to the "unboosted" side (below) of the seal, however, the seal is being forced away from the cone, thereby relieving some of the pre-load in the seal and creating a less effective seal than when pressure is applied to the "boosted" side. This can be the case regardless of whether the liner hanger main body and cone are integral or if they are separate components but still connected (constrained) together. This unboosted characteristic of cone-set seals can be eliminated by uncoupling the attached side of the packer cone 120 (or pusher sleeve 204) from the other components of the liner hanger 102 and allowing it to free float, such that pressure applied to either side enhances the seal.

FIG. 9 shows this uncoupled, floating packer cone 120 in the liner hanger assembly. The packer cone 120, once uncoupled, is sealed against the main body 112 (via seal 1000) but is otherwise unattached and able to float axially with respect to the main body 112 and to the other lower components (e.g., spacer 206, etc.) of the liner hanger 102. As a result, when pressure is applied from above (arrow 1002), the packer seal 122 is boosted towards the cone 120. When pressure is applied from below (arrows 1004), the packer cone 120 is boosted towards the packer seal 122. This allows for a desirable pressure seal on both sides of the seal 122 once it is set, as well as a better pressure seal when high setting loads are not available to initially set the seal 122 against the packer cone 120. The packer cone 120 may be decoupled from the other equipment/accessories of the liner hanger 102 during the liner hanger setting process. The disclosed floating cone locking assembly 226 keeps the packer cone 120 locked to these components of the liner hanger 102 during run in and until it is time to set the seal 122.

Figure 10:
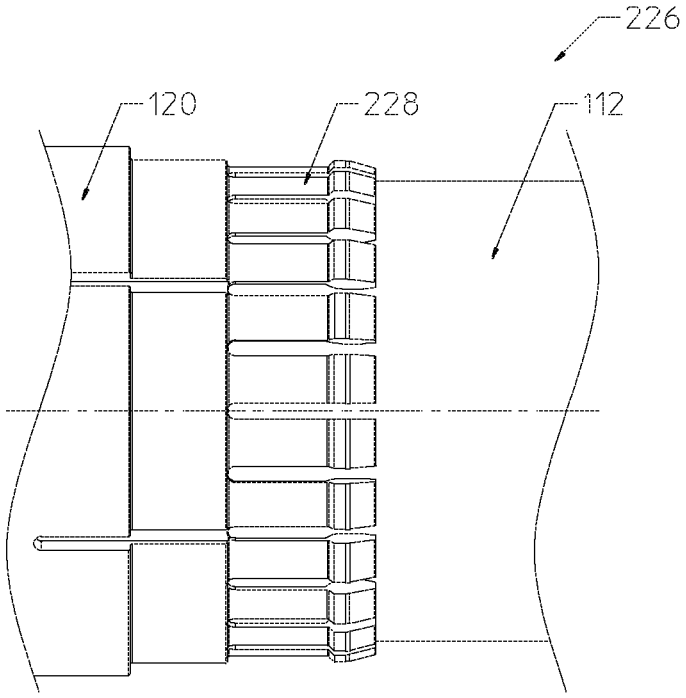
FIG. 10 is a perspective cutaway view of a floating cone locking assembly of the liner hanger of FIG. 2, in accordance with an embodiment of the present disclosure.

FIG. 10 illustrates an embodiment of the floating cone locking assembly 226. The locking assembly 226 includes the collet 228, which locks the packer cone 120 to accessories that operate the liner hanger 102 and then decouples the packer cone 120 from these accessories at a certain location when the liner hanger 102 is at its final set position, thereby creating the desired de-coupled scenario of FIG. 9.

Figure 11A:
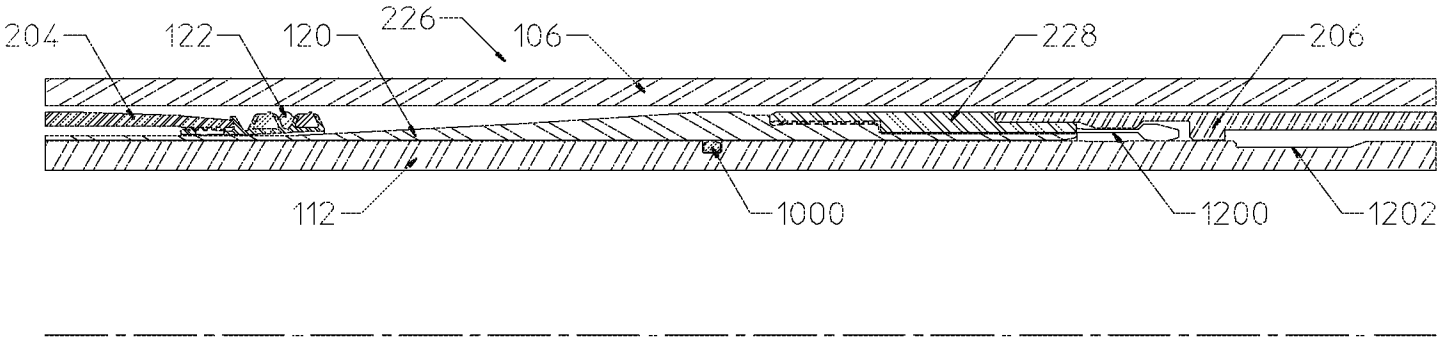
FIGS. 11A and 11B are cross-sectional views of the floating cone locking assembly of FIG. 10, in accordance with an embodiment of the present disclosure.
Figure 11B:
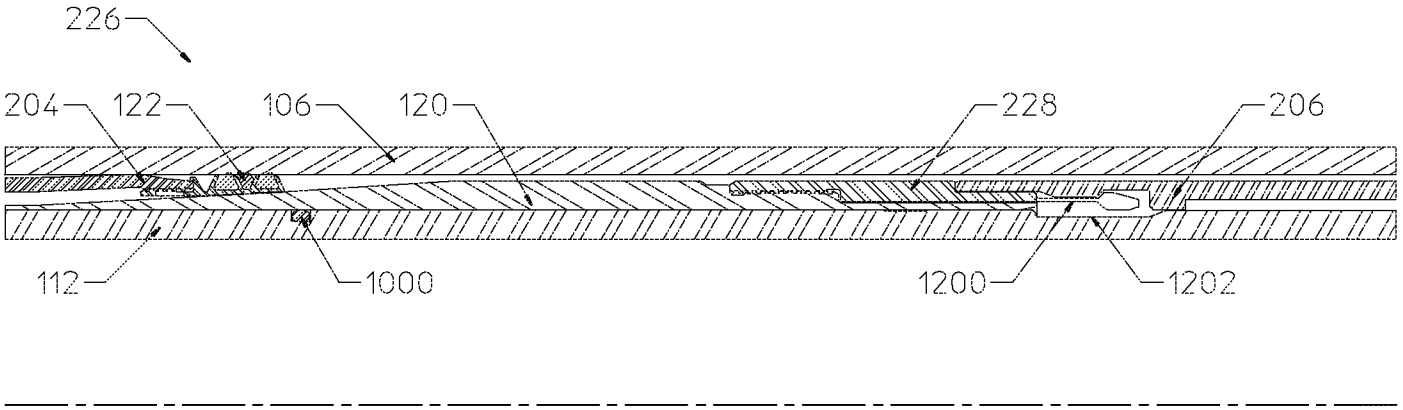

FIGS. 11A and 11B illustrate the floating cone locking assembly 226 during operation. FIG. 11A shows the floating cone locking assembly 226 in the locked configuration. In this configuration, a plurality of fingers 1200 of the collet 228 are held between a corresponding radially inner wall profile 1201 of the spacer 206 and the liner hanger main body 112. The main body 112 has a recess 1202 formed therein at a different axial location from where the collet 228 is locked during run in. Once the liner hanger 102 is in a desired position for unlocking the packer cone 120 so that it can free float relative to the spacer 206 and other accessories of the liner hanger 102, the locking assembly 226 can be unlocked. Additional weight is set down on the liner hanger 102, causing the packer cone 120 and its attached collet 228 to move downward relative to the main body 112 until the collet fingers 1200 are received in the recess 1202 of the main body 112, as shown in FIG. 11B. The decoupling action happens when the collet 228 reaches the recess 1202 in the body 112 and allows the collet 228 to become unconstrained and to bend. In this position, the packer cone 120 is unlocked and able to float freely relative to the spacer 206 and the main body 112 so that it can seal against pressure in both directions. For example, if pressure is acting upward on the packer cone 120 (from below), the packer cone 120 and collet 228 may be pushed in an upward direction such that the fingers 1200 of the collet 228 are pulled out from under the spacer 206 by a certain amount. This may or may not occur, depending on the pressures that are experienced on the packer assembly.

The disclosed locking assembly 226 decouples the packer cone 120 from all other accessories of the liner hanger 102 that may prevent it from being free floating or that may cause the movement of the packer cone 120 to adversely affect the setting of other components such as the hold-down slips 116.

Method of Operating Liner Hanger

Figure 12:
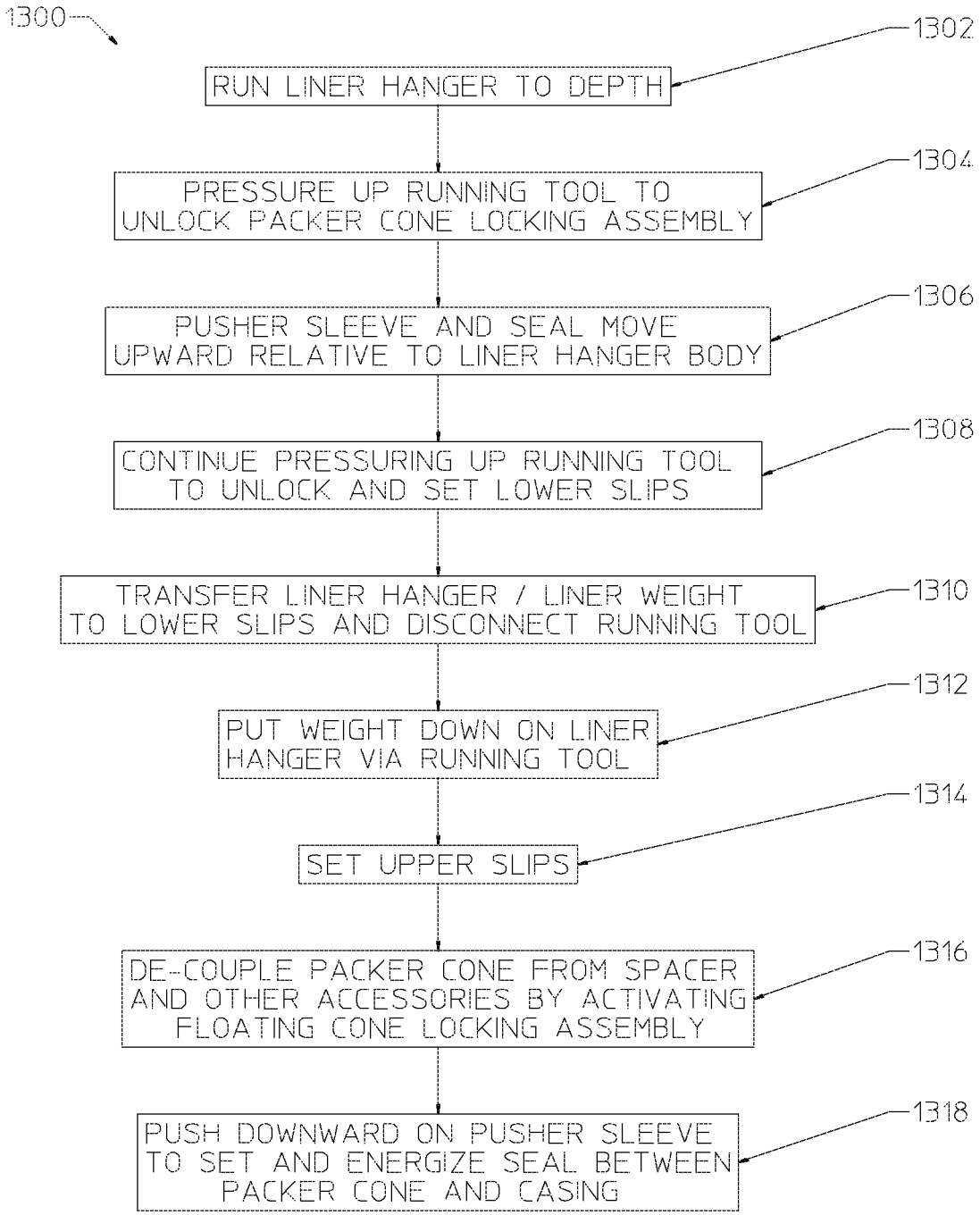
FIG. 12 is a process flow diagram illustrating a method of operating the liner hanger of FIG. 2 during liner hanger running and setting operations, in accordance with an embodiment of the present disclosure.

As mentioned above, FIG. 12 illustrates a method 1300 of operating the entire liner hanger (102 of FIG. 2) during its running and setting operations. As shown in FIG. 12, the liner hanger 102 is first run to depth (block 1302). Upon the liner hanger 102 reaching its ultimate depth within the casing 106, the running tool 108 pressures up to unlock the packer cone locking assembly 208 (block 1304). This pressuring up causes the pusher sleeve 204 and the seal 122 to move upward relative to the main body 112 (block 1306). The running tool 108 continues to pressure up to unlock and set the lower slips 114 (block 1308). More specifically, with the packer cone locking assembly 208 already unlocked, the packer cone 120 and its connected equipment (i.e., spacer 206) will move in the upward direction, thereby pulling up on the tie-bars 210 via the actuation assembly 212. The tie-bars 210 pull upward on the lock ring 602 to unlock the slip locking assembly 214, thereby unlocking and setting the lower slips 114, as described above with reference to FIGS. 5, 6A, 6B, 6C. The weight of the liner hanger 102 and attached liner is then transferred to the lower slips 114, and the running tool 108 is disconnected from the liner (block 1310). The running tool 108 will then put weight down on the liner hanger 102 (block 1312). This downward force sets the upper slips 116 (block 1314), and de-couples the packer cone 120 from the spacer 206 and other accessories by activating the floating cone locking assembly 226 (block 1316). The additional weight put down on the liner hanger 102 pushes downward on the pusher sleeve 204 to ultimately set the seal 122 between the packer cone 120 and the casing 108 (block 1318). At this point, the liner hanger 102 is fully set.

Although the present disclosure and its advantages have been described in detail, it should be understood that various changes, substitutions and alterations can be made herein without departing from the spirit and scope of the disclosure as defined by the following claims.

What is claimed is:

1. A liner hanger comprising:

a liner hanger body;

lower slips coupled to the liner hanger body and configured to be set against a first frustoconical surface of the liner hanger;

upper slips coupled to the liner hanger body and configured to be set against a second frustoconical surface of the liner hanger;

a packer cone coupled to the liner hanger body;

a seal configured to be set and energized against the packer cone to seal an annulus between the liner hanger and an outer casing; and a packer cone locking assembly comprising a collet, wherein the packer cone locking assembly is configured to be transitioned from a locked position in which the packer cone is axially locked to the liner hanger body by the packer cone locking assembly to an unlocked position in which the packer cone is axially movable with respect to the liner hanger body.

2. The liner hanger of claim 1, wherein the packer cone locking assembly further comprises:

a pusher sleeve disposed around a portion of the liner hanger body and the packer cone;

a shear mechanism attaching the collet to the pusher sleeve; and one or more lugs disposed within a groove formed in the liner hanger body, wherein the collet is disposed over the one or more lugs and between the pusher sleeve and the liner hanger body.

3. The liner hanger body of claim 2, wherein the collet holds the one or more lugs in the groove when the packer cone locking assembly is in the locked position, and wherein the collet releases the one or more lugs from the groove upon unlocking the packer cone locking assembly.

4. The liner hanger of claim 2, wherein the one or more lugs are disposed within one or more slots formed at an axial location within the packer cone.

5. The liner hanger of claim 2, wherein the seal is disposed between a lower end of the pusher sleeve and the packer cone.

6. The liner hanger of claim 1, further comprising:

a slip locking assembly comprising a collet that is movable in response to movement of the packer cone with respect to the liner hanger body, wherein the slip locking assembly is configured to be transitioned from a locked position in which the lower slips are axially locked to the liner hanger body to an unlocked position in which the lower slips are axially movable with respect to the liner hanger body.

7. The liner hanger of claim 6, further comprising a plurality of tie-bars coupled to a lower end of the packer cone and axially movable in response to movement of the packer cone with respect to the liner hanger body, wherein the collet of the slip locking assembly is movable in response to axial movement of the plurality of tie-bars.

8. The liner hanger of claim 7, further comprising:

a spacer coupled to the lower end of the packer cone and axially movable with the packer cone; and a ring attached to the spacer, wherein an upper end of each of the plurality of tie-bars is connected to the ring.

9. The liner hanger of claim 7, wherein the slip locking assembly further comprises a lock ring disposed around the collet of the slip locking assembly, wherein the lock ring is disposed between the collet of the slip locking assembly and the lower slips and is axially movable in response to upward movement of the plurality of tie-bars.

10. The liner hanger of claim 9, wherein fingers of the collet of the slip locking assembly are received in a groove formed in the liner hanger body and held in the groove via the lock ring when the slip locking assembly is in the locked position.

11. The liner hanger of claim 1, further comprising:

a first set of guide rails that prevent the lower slips from being wedged in a radially outward direction during run in of the liner hanger; and a second set of guide rails that prevent the upper slips from being wedged in a radially outward direction during run in of the liner hanger.

12. The liner hanger of claim 11, wherein the first and second set of guide rails are part of the liner hanger body.

13. The liner hanger of claim 1, further comprising:

a spacer disposed proximate a lower end of the packer cone; and a floating cone locking assembly that releases the packer cone from being connected to the spacer when the floating cone locking assembly is unlocked.

14. The liner hanger of claim 13, wherein the floating cone locking assembly comprises:

a collet coupled to and extending from the packer cone, wherein the collet is disposed between a radially outer edge of the liner hanger body and a profile on a radially inner edge of the spacer; and a groove formed in the liner hanger body that facilitates release of the collet from the spacer upon axial movement of the packer cone and the spacer with respect to the liner hanger body.

15. A method, comprising:

running a liner hanger through an outer casing, wherein the liner hanger comprises:

a liner hanger body;

lower slips coupled to the liner hanger body;

upper slips coupled to the liner hanger body;

a packer cone coupled to the liner hanger body; and a seal disposed proximate the packer cone;

transitioning a packer cone locking assembly of the liner hanger from a locked position in which the packer cone is axially locked to the liner hanger body by the packer cone locking assembly to an unlocked position in which the packer cone is axially movable with respect to the liner hanger body, wherein the packer cone locking assembly comprises a collet; and after unlocking the packer cone locking assembly:

setting the lower slips against a first frustoconical surface of the liner hanger, setting the upper slips against a second frustoconical surface of the liner hanger, and setting and energizing the seal against the packer cone to seal an annulus between the liner hanger and the outer casing.

16. The method of claim 15, wherein transitioning the packer cone locking assembly from the locked position to the unlocked position comprises:

pressuring up a running tool used to run the liner hanger into the outer casing;

moving the liner hanger body in a downward direction relative to a pusher sleeve disposed around the liner hanger body in response to pressuring up the running tool;

uncovering one or more lugs via the collet, wherein the collet is attached to the pusher sleeve via a shear mechanism;

releasing the one or more lugs from a groove in the liner hanger body upon uncovering the one or more lugs; and enabling the one or more lugs and the packer cone to move axially with respect to the liner hanger body, wherein the one or more lugs are disposed within one or more slots formed in the packer cone.

17. The method of claim 15, further comprising, after unlocking the packer cone assembly:

pressuring up a running tool used to run the liner hanger into the outer casing;

moving the liner hanger body in a downward direction relative to the packer cone in response to pressuring up the running tool, wherein the packer cone is disposed around the liner hanger body;

pulling upward on a plurality of tie-bars via an actuation assembly coupled to the packer cone; and pulling upward on a lock ring of a slip locking assembly of the liner hanger via the plurality of tie-bars to transition the slip locking assembly from a locked position to an unlocked position and to set the lower slips.

18. The method of claim 15, further comprising, after setting the lower slips:

transferring a weight of the liner hanger and an attached liner to the lower slips;

disconnecting a running tool from the liner hanger;

putting weight down on the liner hanger via the disconnected running tool; and setting the upper slips via the weight put down on the liner hanger.

19. The method of claim 15, further comprising, while running the liner hanger through the outer casing:

preventing the lower slips from being wedged in a radially outward direction via a first set of guide rails of the liner hanger; and preventing the upper slips from being wedged in a radially outward direction via a second set of guide rails of the liner hanger.

20. The method of claim 15, further comprising:

setting weight down on the liner hanger after setting the lower slips and the upper slips;

releasing a floating cone locking assembly of the liner hanger in response to setting the weight down on the liner hanger, wherein releasing the floating cone locking assembly de-couples the packer cone from a spacer disposed proximate a lower end of the packer cone; and after de-coupling the packer cone from the spacer, setting additional weight down on the liner hanger to set the seal between the packer cone and the outer casing.

* * * * *